US009633628B2

(12) United States Patent
Kim et al.

(10) Patent No.: US 9,633,628 B2
(45) Date of Patent: Apr. 25, 2017

(54) METHOD OF DRIVING DISPLAY DEVICE AND DISPLAY DEVICE FOR PERFORMING THE SAME

(71) Applicant: SAMSUNG DISPLAY CO., LTD., Yongin, Gyeonggi-Do (KR)

(72) Inventors: Jung-Taek Kim, Seoul (KR); Kyoung-Ho Lim, Suwon-si (KR); Jae-Hoon Lee, Seoul (KR); Woo-Seok Jang, Suwon-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 266 days.

(21) Appl. No.: 14/510,337

(22) Filed: Oct. 9, 2014

(65) Prior Publication Data

US 2015/0130784 A1 May 14, 2015

(30) Foreign Application Priority Data

Nov. 14, 2013 (KR) ..... 10-2013-0137991

(51) Int. Cl.
*G09G 5/36* (2006.01)
*G09G 5/18* (2006.01)
*G09G 5/393* (2006.01)

(52) U.S. Cl.
CPC ..... *G09G 5/18* (2013.01); *G09G 5/393* (2013.01); *G09G 2370/08* (2013.01)

(58) Field of Classification Search
CPC . G06T 1/60; G09G 5/18; G09G 5/393; G09G 2370/08; G09G 5/39; G09G 2310/0213; G09G 2310/00; G09G 2310/0243; G09G 2310/0264; G09G 2330/00; G09G 2330/021
USPC ..... 345/530, 531, 533, 534, 536, 537, 538, 345/543, 544, 545, 553
See application file for complete search history.

(56) References Cited

U.S. PATENT DOCUMENTS 5,881,016 A * 3/1999 Kenkare ..... G09G 5/39 365/203
2005/0046619 A1 3/2005 Senda et al.
2006/0038759 A1* 2/2006 Hong ..... G09G 3/3648 345/87
2006/0145963 A1 7/2006 Kim
2006/0279489 A1* 12/2006 Ouchi ..... G09G 3/20 345/76

(Continued)

FOREIGN PATENT DOCUMENTS

KR 10-2006-0042602 A 5/2006
KR 10-2006-0077364 A 7/2006
KR 10-2007-0041178 A 4/2007

*Primary Examiner* — Xiao Wu
*Assistant Examiner* — Sarah Lhymn
(74) *Attorney, Agent, or Firm* — Lee & Morse, P.C.

(57) ABSTRACT

A method of driving a display device includes a writing operation and a reading operation. The writing operation includes writing first to Mth frame data in a first frame memory during first to Mth frame periods. The reading operation includes reading (L−M)th and (L−M+1)th frame data among the first to Mth frame data from the first frame memory during an Lth frame period. M may be three or more, and L may be an integer ranging from (M+1) to (2M−1). The frame data read from the first frame memory corresponds to an image to be displayed. Reading and writing operations are further performed for remaining ones of the frame memories.

20 Claims, 9 Drawing Sheets

(56) References Cited

U.S. PATENT DOCUMENTS

| | | | | |
|---|---|---|---|---|
| 2007/0080920 | A1* | 4/2007 | Hosaka | G09G 3/3648 345/98 |
| 2007/0091059 | A1* | 4/2007 | Kang | G09G 3/342 345/102 |
| 2012/0256883 | A1* | 10/2012 | Okada | G06F 1/3203 345/175 |
| 2013/0258241 | A1* | 10/2013 | Higano | G02F 1/133606 349/61 |

* cited by examiner

METHOD OF DRIVING DISPLAY DEVICE AND DISPLAY DEVICE FOR PERFORMING THE SAME

CROSS-REFERENCE TO RELATED APPLICATION(S)

Korean Patent Applications No. 10-2013-0137991, filed on Nov. 14, 2013, and entitled, "Method of Driving Display Device and Display Device for Performing the Same," is incorporated by reference herein in its entirety.

BACKGROUND

1. Field

One or more embodiments described herein relate to a display device.

2. Description of the Related Art

Various methods have been used to drive a display device. In a progressive emission method, image data is stored in a frame memory of the display device. The image data is stored in frame units and is read from the frame memory on a scan line basis for purposes of displaying an image. Another method, known as an asynchronous display method, drives a display in a way that attempts to reduce blank time. (Blank time may refer to a time point at which image data corresponding to one scan line and read from the frame memory is not synchronized with a time point at which image data corresponding to the scan line is written to the frame memory).

The asynchronous driving method and a sequential emission driving method controls the display of images based on three-frame data during one frame period using four frame memories. For example, in one frame period, one frame data corresponding to the frame period is written to three of the four frame memories. Also, the three frame data corresponding to previous three frame periods are read from the other one of the four frame memories to display an image. Thus, the display device needs four frame memories to display an image.

SUMMARY

In accordance with one embodiment, a method of driving a display device includes writing first to Mth frame data in a first frame memory among first through third frame memories during first to Mth frame periods; and reading (L−M)th and (L−M+1)th frame data among the first to Mth frame data from the first frame memory during an Lth frame period, wherein L is an integer ranging from (M+1) to (2M−1) and wherein the frame data read from the first frame memory corresponds to an image to be displayed.

The first frame memory may be in a standby mode during (2M)th to (3M−3)th frame periods. M may be a maximum number of frame data that are simultaneously stored in the first frame memory.

The method may also include writing Mth to (2M−1)th frame data in the second frame memory during Mth to (2M−1)th frame periods; and reading (L−1)th and Lth frame data among the Mth to (2M−1)th frame data from the second frame memory during an (L+M−1)th frame period, wherein the frame data read from the second frame memory corresponds to the image to be displayed. The second frame memory may be in a standby mode during (3M−1)th to (4M−4)th frame periods.

The method may also include writing (2M−1)th to (3M−2)th frame data in the third frame memory during (2M−1)th to (3M−2)th frame periods; and reading (L+M−2)th and (L+M−1)th frame data among (2M−1)th to (3M−2)th frame data from the third frame memory during an (L+2M−2)th frame period, wherein the frame data read from the third frame memory corresponds the image to be displayed. The third frame memory may be in a standby mode during (4M−2)th to (5M−5)th frame periods.

The method may also include generating the image by driving pixels in upper and lower regions of the display device based on the read frame data. The pixels in the upper region may be sequentially driven from top to bottom, and the pixels in the lower region may be sequentially driven from top to bottom.

The pixels in the upper region may be sequentially driven from bottom to top, and the pixels in the lower region may be sequentially driven from bottom to top.

The pixels in the upper region may be sequentially driven from bottom to top, and the pixels in the lower region may be sequentially driven from top to bottom.

The pixels in the upper region may be sequentially driven from top to bottom, and the pixels in the lower region may be sequentially driven from bottom to top.

In accordance with another embodiment, a display device includes a display panel having a plurality of pixels; a scan driving unit configured to provide a scan signals to the pixels; a data driving unit configured to provide data signals to the pixels; a timing control unit configured to control the scan driving unit and the data driving unit; and first through third frame memories coupled to the timing control unit. The timing control unit writes first to Mth frame data in one of the first through third frame memories during first to Mth frame periods; and reads (L−M)th and (L−M+1)th frame data among the first to Mth frame data from the one of the first through third frame memories during an Lth frame period, wherein L is an integer ranging from (M+1) to (2M−1) and wherein the frame data read from the one of the first through third frame memories corresponds to an image to be displayed.

The one of the first through third frame memories may be in a standby mode during (2M)th to (3M−3)th frame periods. M may be a maximum number of frame data that are to be simultaneously stored in the one of the first through third frame memories.

The data driving unit may include a first data driving unit configured to provide data signals to pixels in an upper region of the display panel; and a second data driving unit configured to provide data signals to pixels in a lower region of the display panel. The first data driving unit may provide data signals to the pixels in the upper region from top to bottom, and the second data driving unit may provide data signals to the pixels in the lower region from top to bottom.

The first data driving unit may provide data signals to the pixels in the upper region from bottom to top, and the second data driving unit may provide data signals to the pixels in the lower region from bottom to top.

The first data driving unit may provide data signals to the pixels in the upper region from bottom to top, and the second data driving unit may provide data signals to the pixels in the lower region from top to bottom.

The first data driving unit may provide data signals to the pixels in the upper region from top to bottom, and the second data driving unit may provide data signals to the pixels in the lower region from bottom to top.

BRIEF DESCRIPTION OF THE DRAWINGS

Features will become apparent to those of skill in the art by describing in detail exemplary embodiments with reference to the attached drawings in which.

DETAILED DESCRIPTION

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Figure 1A:
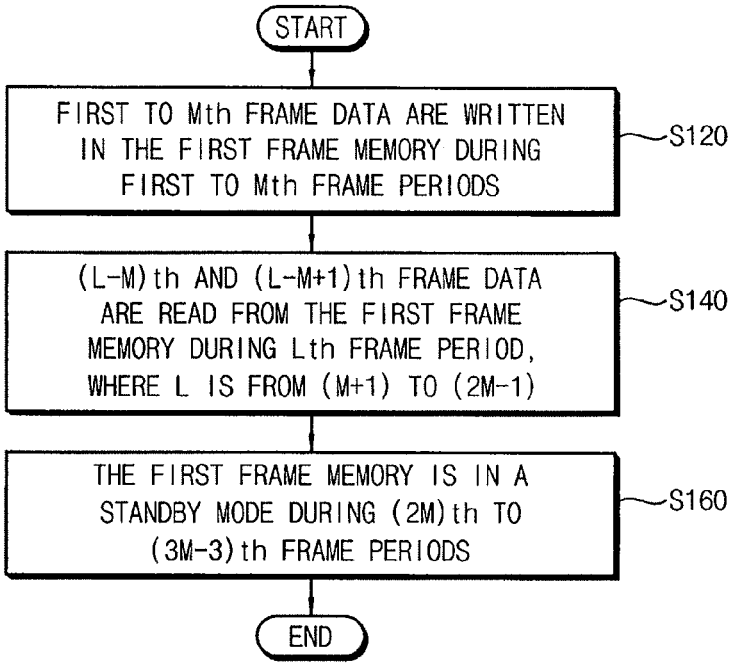
FIGS. 1A-1C illustrate embodiments of methods of driving a display device.
Figure 1B:
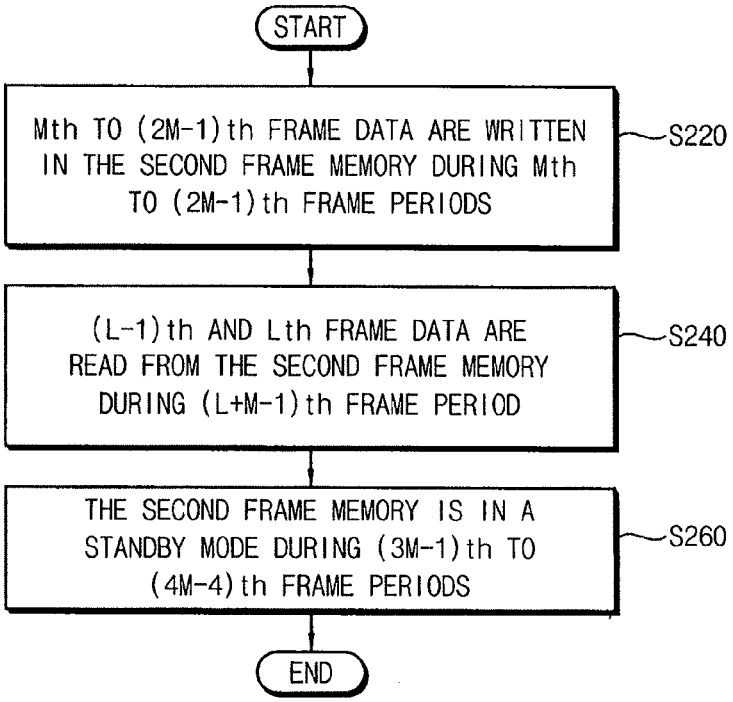
Figure 1C:
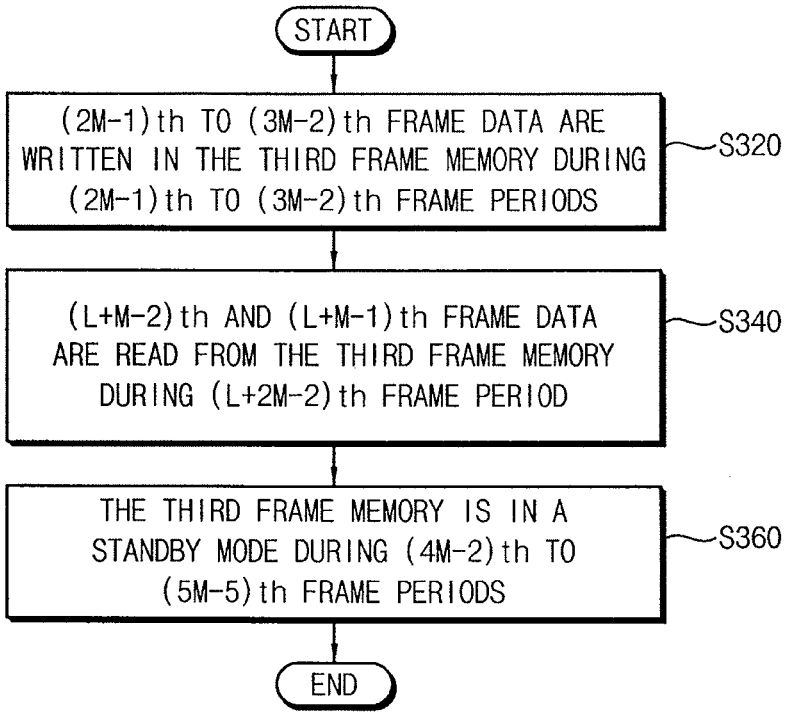

FIGS. 1A-1C illustrate embodiments of methods for driving a display device which includes a first frame memory, a second frame memory, and a third frame memory. Referring to FIG. 1A, first to Mth frame data may be written in one of the first through third frame memories during first to Mth frame periods, where M is an integer greater than or equal to 3 (S120). Subsequently, (L−M)th and (L−M+1)th frame data may be read among the first to Mth frame data from the one of the first through third frame memories during an Lth frame period. An image is displayed based on the (L−M)th and (L−M+1)th frame data during the Lth frame period, where L is an integer ranging from (M+1) to (2M−1) (S140). The one of the first through third frame memories may be in a standby mode during (2M)th to (3M−3)th frame periods (S160).

For example, the first to the Mth frame data may be written in the first frame memory during the first to Mth frame periods, operation S120. Thus, frame data corresponding to respective frame periods may be successively written in the first frame memory. Because M corresponds to the number of frame data that are successively stored in the first frame memory and M is greater than or equal to 3, the method of FIG. 1A may allow for a reduction in the number of frame memories.

In one example embodiment, M may be the maximum number of frame data that may be simultaneously stored in the first frame memory. The larger the value of M, the longer the frame period during which the first frame memory is in standby mode. Thus, power consumption may be reduced in proportion to an increase in the number of frame data that are successively stored in one frame memory. Therefore, successively writing the greatest number of frame data in the first frame memory allows for a lengthening of the frame periods during which frame memories are in standby mode. This may allow for a further reduction in power consumption.

The (L−M)th and (L−M+1)th frame data may be read among the first to Mth frame data from the first frame memory during an Lth frame period (S140), where L is an integer ranging from (M+1) to (2M−1). As a result, the image may be displayed based on the (L−M)th and (L−M+1)th frame data during the Lth frame period. Thus, two successive frame data may be read among the first to Mth frame data, and the image may be displayed based on the two successive frame data.

For example, the first and second frame data are read from the first frame memory during (M+1)th frame period. An image is then displayed based on the first and second frame data. The second and third frame data are read from the first frame memory during a (M+2)th frame period. An image is then displayed based on the second and third frame data. Similarly, the (M−1)th and Mth frame data are read from the first frame memory during a (2M−1)th frame period. An image is then displayed based on the (M−1)th and the Mth frame data. Thus, during (M+1)th to (2M−1)th frame periods, the images are displayed using the first frame memory.

The first frame memory may be in standby mode during (2M)th to (3M−3)th frame periods (S160). The frame data corresponding to respective frame periods may be successively written in the first frame memory. An image is then displayed based on two successive frame data in one frame period, so that the first frame memory may be in the standby mode up to M−2 frame periods. Therefore, the larger M is, the longer the frame periods are in which frame memories are in standby mode. This has the effect of reducing power consumption more effectively.

Referring to FIG. 1B, the method shown therein is performed in parallel with the method of FIG. 1A. Here, Mth to (2M−1)th frame data are written in the second frame memory during Mth to (2M−1)th frame periods (S220). Thus, frame data corresponding to respective frame periods may be successively written in the second frame memory. The (L−1)th and Lth frame data may be read among the Mth to (2M−1)th frame data from the second frame memory during the (L+M−1)th frame period. As a result, the image is displayed based on the (L−1)th and Lth frame data during the (L+M−1)th frame period (S240).

Thus, two successive frame data may be read from the second frame memory, among the Mth to (2M−1)th frame data during (2M)th to (3M−2)th frame periods. An image may be then displayed based on the two successive frame data. If the first frame memory is in writing mode or standby mode, frame data are read from the second frame memory or the third frame memory and the image is displayed.

For example, the Mth and (M+1)th frame data are read from the second frame memory during a (2M)th frame period. An image is then displayed based on the Mth and (M+1)th frame data. The (M+1)th and (M+2)th frame data are read from the second frame memory during a (2M+1)th frame period. An image is then displayed based on the (M+1)th and (M+2)th frame data. Similarly, the (2M−2)th and (2M−1)th frame data are read from the second frame memory during a (3M−2)th frame period. An image is then displayed based on the (2M−2)th and (2M−1)th frame data.

The second frame memory may be in standby mode during (3M−1)th to (4M−4)th frame periods (S260). The frame data corresponding to respective frame periods may be successively written in the second frame memory. Also, an image is displayed based on two successive frame data in one frame period, so that the second frame memory may be in standby mode up to M−2 frame periods.

Referring to FIG. 1C, the method shown therein is performed in parallel with the methods of FIGS. 1A and 1B. Here, (2M−1)th to (3M−2)th frame data are written in the third frame memory during (2M−1)th to (3M−2)th frame periods (S320). Thus, frame data corresponding to respective frame periods are successively written in the third frame memory. Also, (L+M−2)th and (L+M−1)th frame data are read among (2M−1)th to (3M−2)th frame data from the third frame memory during an (L+2M−2)th frame period. An image is displayed based on the (L+M−2)th and (L+M−1)th frame data during the (L+2M−2)th frame period. Thus, two successive frame data may be read from the third frame memory among the (2M−1)th to (3M−2)th frame data during (3M−1)th to (4M−3)th frame periods. An image is then displayed based on the two successive frame data.

If the first frame memory and the second frame memory are in writing mode or standby mode, frame data are read from the third frame memory and an image may then be displayed. For example, the (2M−1)th and (2M)th frame data are read from the third frame memory during a (3M−1)th frame period. An image is then displayed based on the (2M−1)th and (2M)th frame data. The (2M)th and (2M+1)th frame data are read from the third frame memory during a (3M)th frame period. An image is then displayed based on the (2M)th and (2M+1)th frame data. Similarly, the (3M−3)th and (3M−2)th frame data are read from the third frame memory during a (4M−3)th frame period. An image is then displayed based on the (3M−3)th and (3M−2)th frame data.

The third frame memory may be in standby mode during (4M−2)th to (5M−5)th frame periods (S360). The frame data corresponding to respective frame periods may be successively written in the third frame memory. An image is displayed based on two successive frame data in one frame period, so that the third frame memory may be in standby mode up to M−2 frame periods.

The second frame memory and the third frame memory may be operated in the same way as the first frame memory in different periods. Therefore, when the first frame memory is in writing mode or standby mode, the frame data is read from the second frame memory or the third frame memory and the image is displayed.

Figure 2:
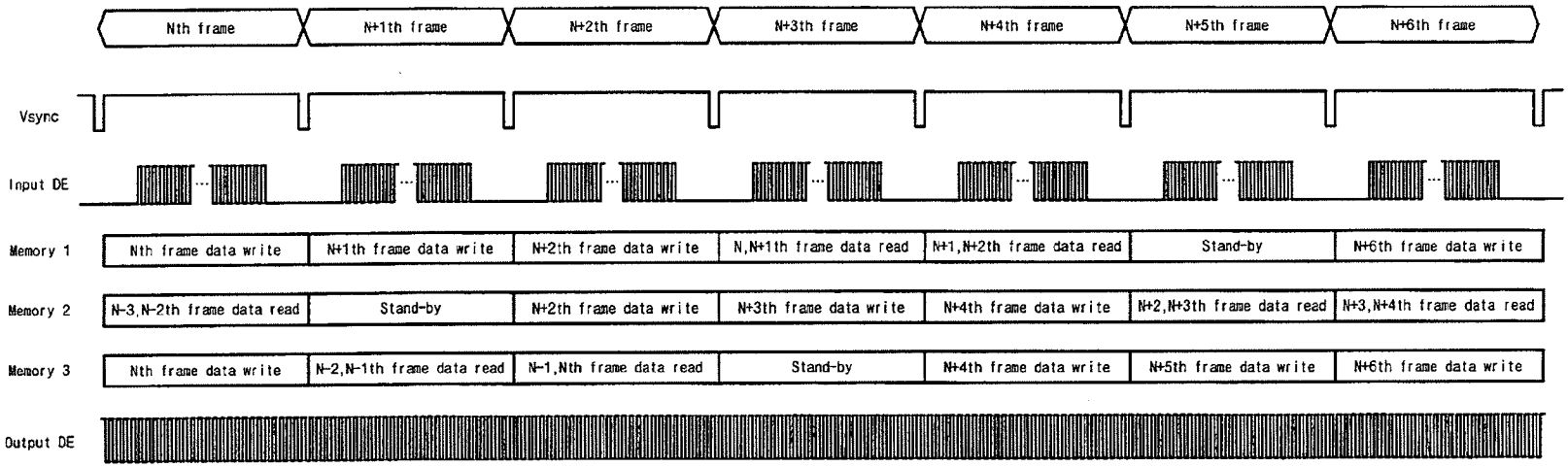
FIG. 2 illustrates an example in which frame memories are operated by the methods in FIGS. 1A-1C.

FIG. 2 is a timing diagram illustrating an example of how the frame memories may be operated in accordance with the methods of FIGS. 1A-1C. Referring to FIG. 2, a predetermined number (e.g., 3) of frame data are successively stored in the frame memory. During an Nth frame period, Nth frame data may be written in the first frame memory and the third frame memory. The (N−3)th and (N−2)th frame data already stored in the second frame memory are read from the second frame memory. The image may be displayed based on the (N−3)th and (N−2)th frame data.

During an (N+1)th frame period, the (N+1)th frame data may be written in the first frame memory. The (N−2)th and (N−1)th frame data already stored in the third frame memory are read from the third frame memory. An image may be displayed based on the (N−2)th and (N−1)th frame data. The second frame memory may be in standby mode.

During an (N+2)th frame period, the (N+2)th frame data may be written in the first frame memory and the second frame memory. The (N−1)th and Nth frame data are read from the third frame memory. An image is displayed based on the (N−1)th and Nth frame data.

During a (N+3)th frame period, the (N+3)th frame data may be written in the second frame memory. The Nth and (N+1)th frame data are read from the first frame memory. The image may be displayed based on the Nth and (N+1)th frame data. The third frame memory may be in standby mode.

During an (N+4)th frame period, the (N+4)th frame data may be written in the second frame memory and the third frame memory. The (N+1)th and (N+2)th frame data are read from the first frame memory. The image is then displayed based on the (N+1)th and (N+2)th frame data.

During a (N+5)th frame period, the (N+5)th frame data may be written in the third frame memory. The (N+2)th and (N+3)th frame data are read from the second frame memory. The image may be displayed based on the (N+2)th and (N+3)th frame data. The first frame memory may be in standby mode.

TABLE 1 represents examples of operations of the frame memories in frame periods according to the example of FIG. 2.

TABLE 1

| frame # | first memory | second memory | third memory |
|---|---|---|---|
| N | write | read | write |
| N + 1 | write | standby | read |
| N + 2 | write | write | read |
| N + 3 | read | write | standby |
| N + 4 | read | write | write |
| N + 5 | standby | read | write |
| N + 6 | write | read | write |
| | | . . . | |

According to the above operations, the display device may be driven using only three frame memories, by displaying an image based on two successive frame data in one frame period. In addition, when the number of frame data that are successively stored in the frame memory is a predetermined number (e.g., M is 3), one of the frame memories is in standby mode once every two frame periods, thereby reducing power consumption.

FIGS. 3A-3D illustrating examples in which image is displayed by methods of FIGS. 1A through 1C. Referring to FIGS. 3A through 3D, an image may be divided into an upper image region and a lower image region. Also, the upper image region and the lower image region may be respectively displayed. The display device that is operated by a digital driving method may control grayscale levels of the image based on a plurality of sub-fields. If the number of sub-fields is increased to improve an ability to express a lower gray scale levels, a shortage of charging time may occur. Therefore, by dividing an image into upper and lower regions, the charging time may be doubled so that a high-resolution display devices may be driven.

When an image is divided into upper and lower regions, the upper image region and the lower image region are respectively displayed in various directions. In one example embodiment, the upper image region may be sequentially displayed from top to bottom, and the lower image region may be sequentially displayed from top to bottom.

In another example embodiment, the upper image region may be sequentially displayed from bottom to top, and the lower image region may be sequentially displayed from bottom to top.

In another example embodiment, the upper image region may be sequentially displayed from bottom to top, and the lower image region may be sequentially displayed from top to bottom.

Figure 3A:
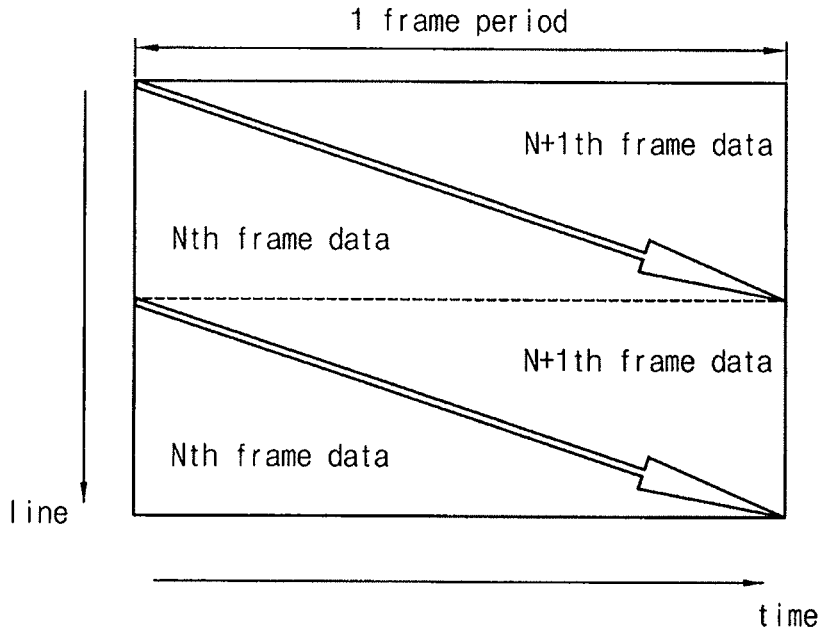
FIGS. 3A-3D illustrate examples of displaying an image by the methods of FIGS. 1A-1C.
Figure 3B:
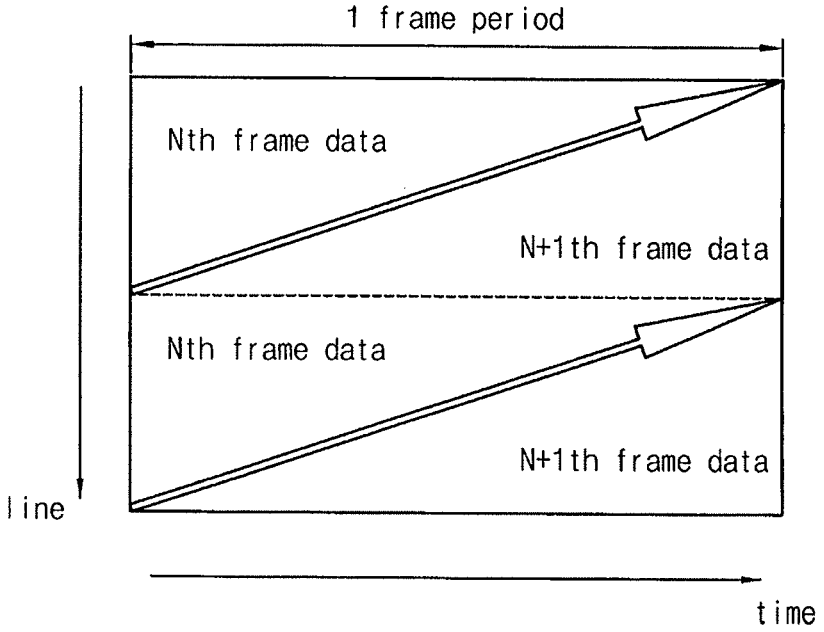

In another example embodiment, the upper image region may be sequentially displayed from top to bottom, and the lower image region may be sequentially displayed from bottom to top. When the upper image region and the lower image region are displayed in same direction such as illustrated in FIGS. 3A and 3B, the display device may be simply driven. However, the image may be discontinuously displayed at the interface between the upper image region and the lower image region, so that the timing control included in the display device needs to control output.

Figure 3C:
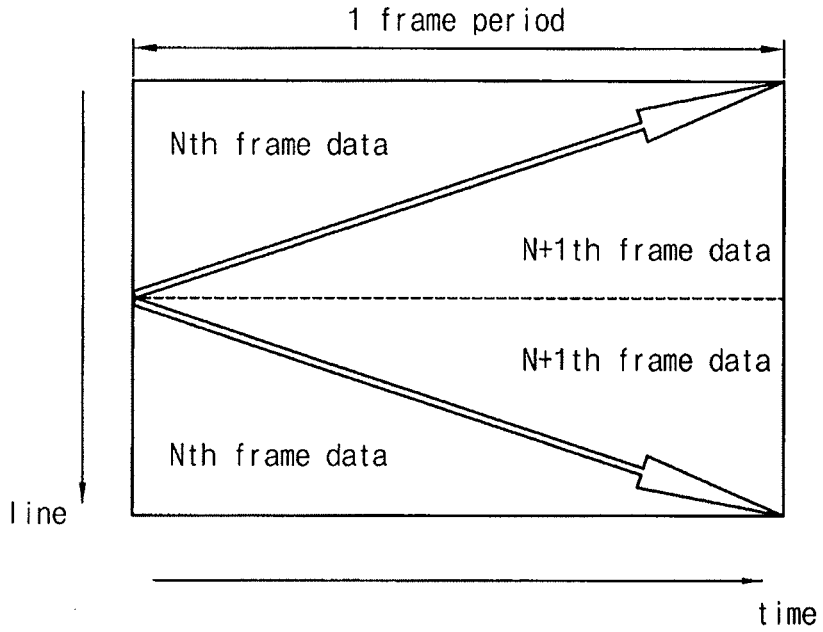
Figure 3D:
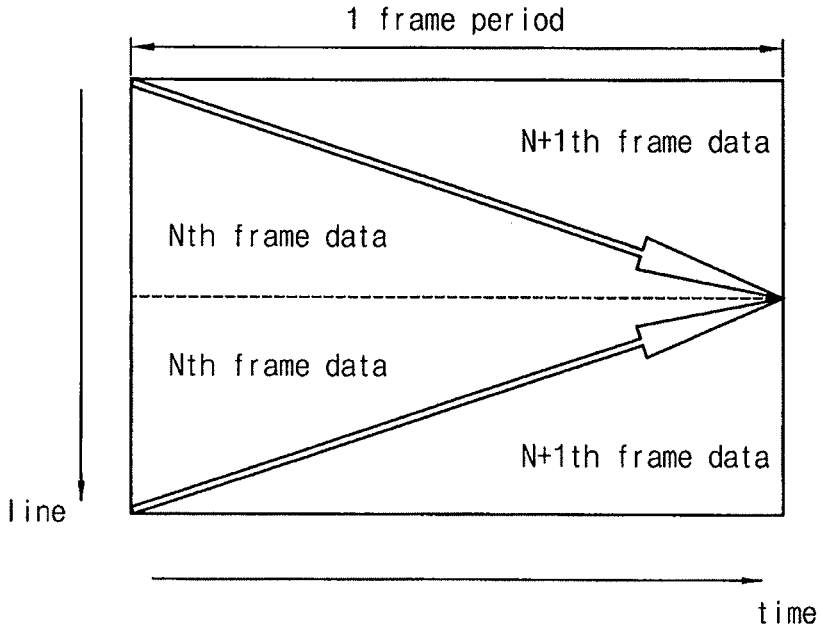

On the other hand, when the upper image region and the lower image region are displayed in different directions such as illustrated in FIGS. 3C and 3D, the image may be continuously displayed at the interface between the upper and lower regions.

Figure 4:
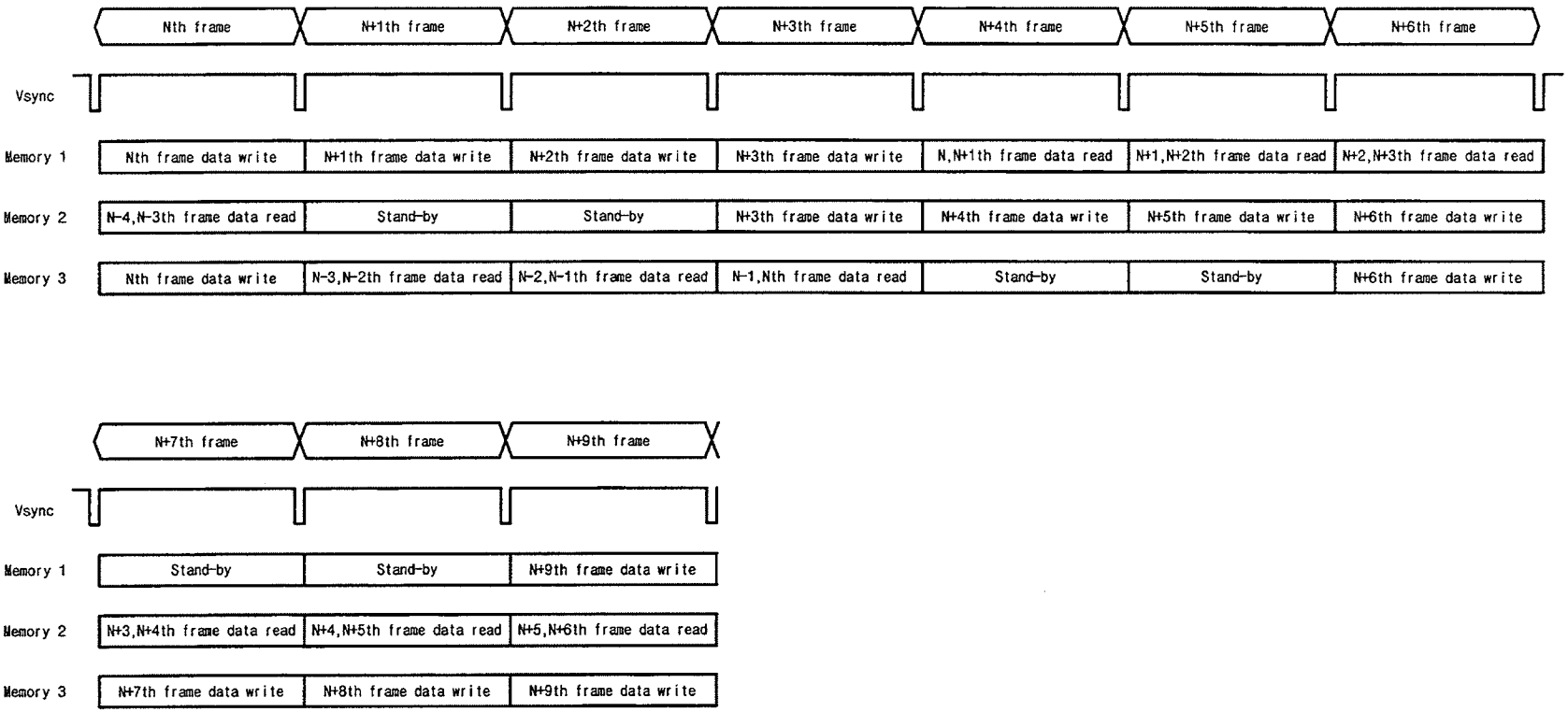
FIG. 4 illustrates another example of operating frame memories by the methods of FIGS. 1A-1C.

FIG. 4 illustrates another embodiment in which frame memories are operated by the methods of FIGS. 1A-1C. Referring to FIG. 4, when a predetermined number (i.e., M is 4) of frame data is successively stored in the frame memory, the frame memories may be operated similar to the method of FIG. 2. Thus, frame data corresponding to respective frame periods may be successively written in the first frame memory during Nth to (N+3)th frame periods. The (L−4)th and (L−3)th frame data may be read among the Nth to (N+3)th frame data from the first frame memory during an Lth frame period, such that the image is displayed based on the (L−4)th and (L−3)th frame data during the Lth frame period. Here, L may be an integer ranging, for example, from (N+4) to (N+6). Thus, two successive frame data may be read among the Nth to (N+3)th frame data from the first frame memory during (N+4)th to (N+6)th frame periods.

The first frame memory may be in standby mode during (N+7)th to (N+8)th frame periods. In addition, the second frame memory and the third frame memory may be operated in the same way as the first frame memory in different periods. Therefore, when the first frame memory is in writing mode or standby mode, the frame data are read from the second frame memory or the third frame memory and the image is displayed.

TABLE 2 shows examples of operations of the frame memories in frame periods according to an example of FIG. 4.

TABLE 2

| frame # | first memory | second memory | third memory |
|---|---|---|---|
| N | write | read | write |
| N + 1 | write | standby | read |
| N + 2 | write | standby | read |
| N + 3 | write | write | read |
| N + 4 | read | write | standby |
| N + 5 | read | write | standby |
| N + 6 | read | write | write |
| N + 7 | standby | read | write |
| N + 8 | standby | read | write |
| N + 9 | write | read | write |
| | | . . . | |

According to the above operations, the display device may be driven using only three frame memories. This may be accomplished by displaying an image based on two successive frame data in one frame period. In addition, when a predetermined number (i.e., M is 4) of frame data are successively stored in the frame memory, one of the frame memories is in standby mode twice every four frame periods, which thereby allows for a reduction in power consumption more effectively than when M is 3.

Figure 5:
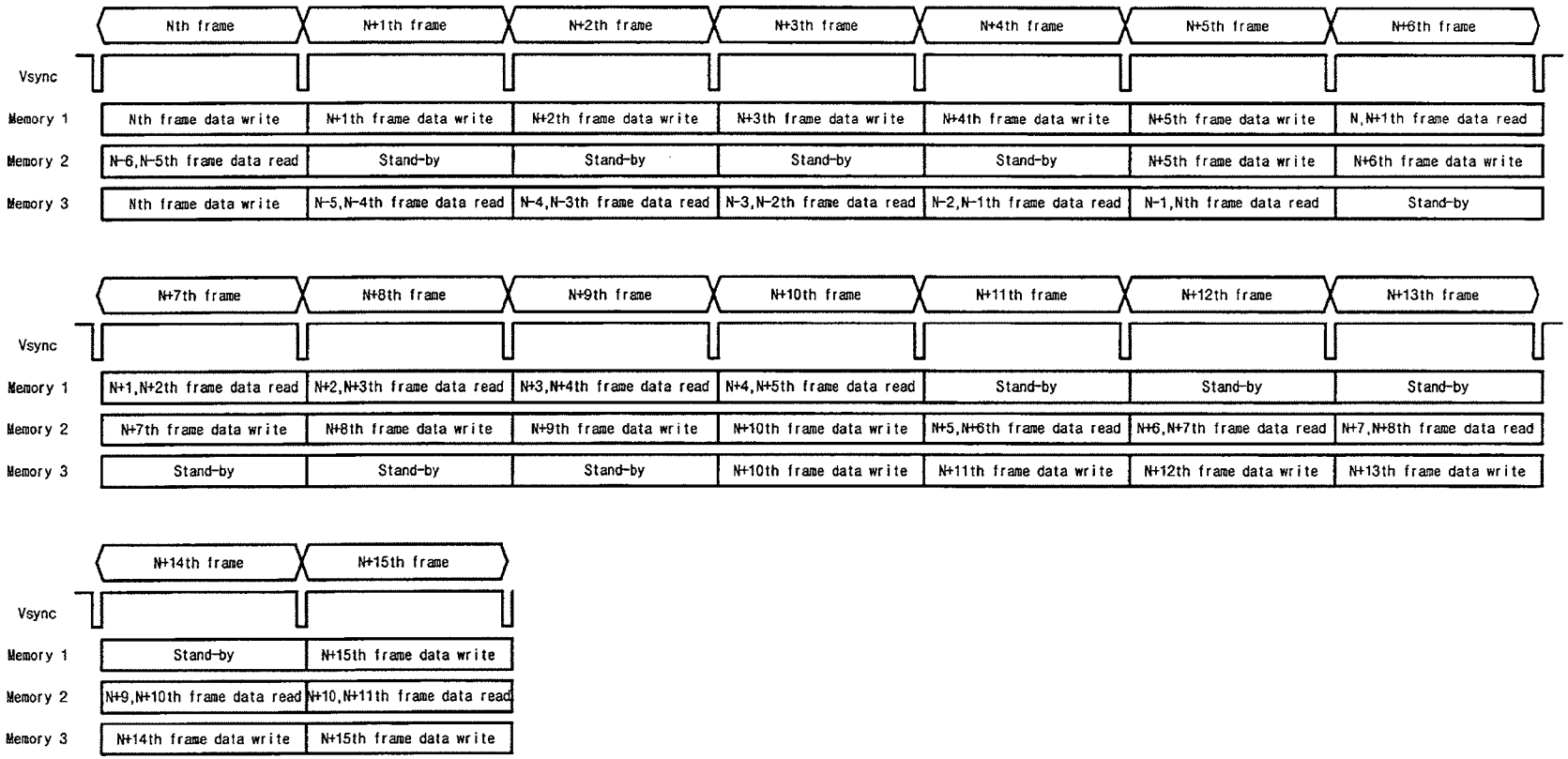
FIG. 5 illustrates another example of operating frame memories by the methods of FIGS. 1A-1C.

FIG. 5 illustrates another example in which frame memories are operated by the methods of FIGS. 1A-1C. Referring to FIG. 5, when a predetermined number of frame data are successively stored in the frame memory, the frame memories (i.e., M is 6) are operated in a manner similar to the method of FIG. 2. Thus, frame data corresponding to respective frame periods may be successively written in the first frame memory during Nth to (N+5)th frame periods. The (L−6)th and (L−5)th frame data may be read among the Nth to (N+5)th frame data from the first frame memory during an Lth frame period, such that the image is displayed based on the (L−6)th and (L−5)th frame data during the Lth frame period. Here, L is an integer ranging from (N+6) to (N+10). Thus, two successive frame data may be read among the Nth to (N+5)th frame data from the first frame memory during (N+6)th to (N+10)th frame periods.

The first frame memory may be in standby mode during (N+11)th to (N+14)th frame periods. In addition, the second frame memory and third frame memory may be operated in the same way as the first frame memory in different periods. Therefore, when the first frame memory is in writing mode or standby mode, the frame data are read from the second frame memory or the third frame memory and the image is displayed.

TABLE 3 shows examples of operations of the frame memories in frame periods according to an example of FIG. 5.

TABLE 3

| frame # | first memory | second memory | third memory |
|---|---|---|---|
| N | write | read | write |
| N + 1 | write | standby | read |
| N + 2 | write | standby | read |
| N + 3 | write | standby | read |
| N + 4 | write | standby | read |
| N + 5 | write | write | read |
| N + 6 | read | write | standby |
| N + 7 | read | write | standby |
| N + 8 | read | write | standby |
| N + 9 | read | write | standby |
| N + 10 | read | write | write |
| N + 11 | standby | read | write |
| N + 12 | standby | read | write |
| N + 13 | standby | read | write |
| N + 14 | standby | read | write |
| N + 15 | write | read | write |
| | | . . . | |

According to the above operations, the display device may be driven using only three frame memories. This may be accomplished by displaying an image based on two successive frame data in one frame period. In addition, when a predetermined number (i.e., M is 6) of frame data are successively stored in the frame memory, one of the frame memories is in standby mode for four times every five frame periods, thereby allowing for a reduction in power consumption more effectively than when M is 4.

In an example application, power consumption of the display panel was measured using an FPGA (Arria V, 5AGXFB5H4F35C4). The display panel had full HD resolution using DDR3 1G memory (SAMSUNG ELECTRONICS CO., LTD, K4B1G1646D-1066) for the frame memories. When six frame data was successively stored in the frame memory, current consumption of one frame memory was measured at about 370 mA in driving mode and about 55 mA in standby mode. Power consumption was measured at about 1.43 W. The power consumption was reduced to about 0.77 W in comparison with other methods. Thus, the example application was effective to decrease power consumption by about 35%.

Figure 6:
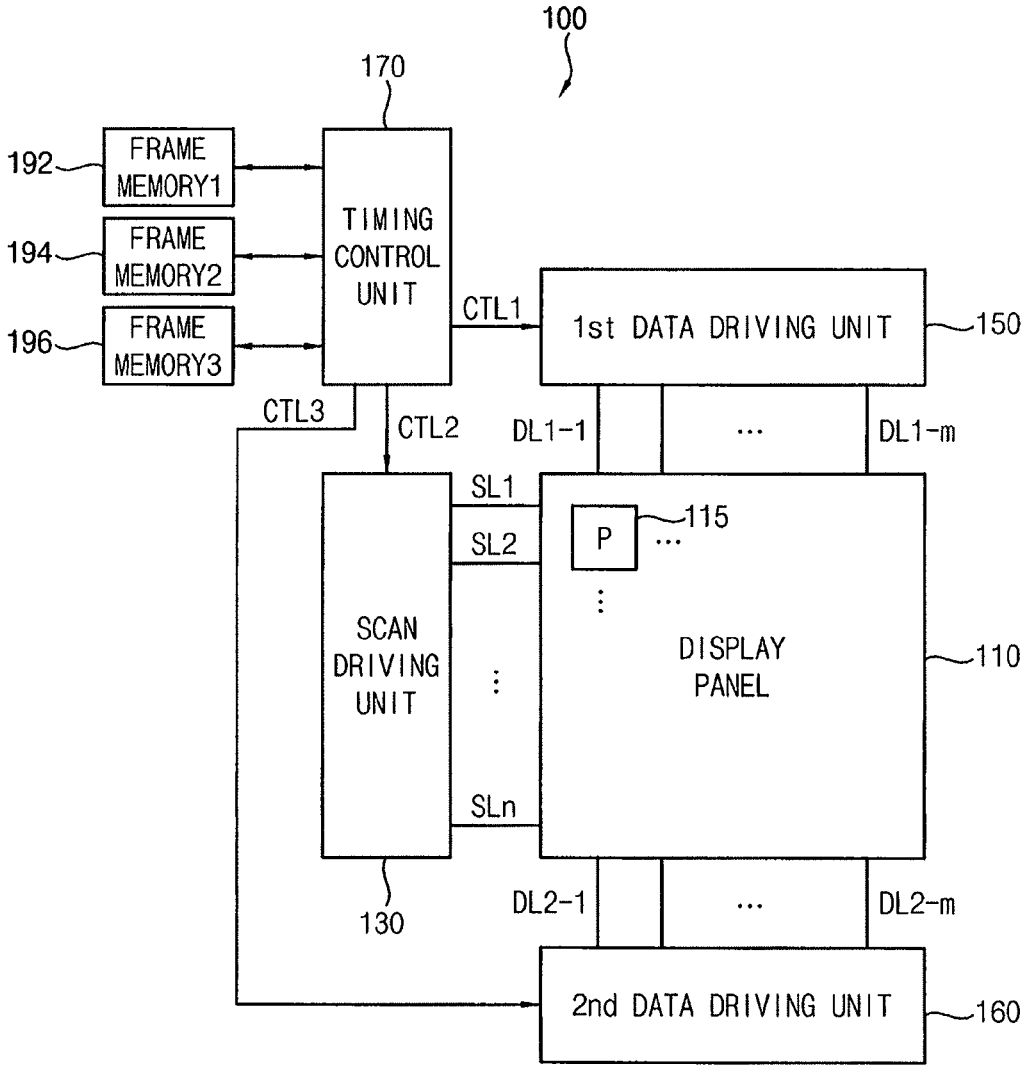
FIG. 6 illustrates an embodiment of a display device.

FIG. 6 illustrates another embodiment of a display device 100 which includes a display panel 110, a scan driving unit 130, a first data driving unit 150, a second data driving unit 160, a timing control unit 170, a first frame memory 192, a second frame memory 194, and a third frame memory 196.

The display panel 110 may include a plurality of pixel circuits 115. The display panel 110 may be coupled to the scan driving unit 130 via a plurality of scan-lines SL1 through SLn. The display panel 110 may be coupled to the first data driving unit 150 and the second data driving unit 160 through a plurality of data-lines DL1-1 through DL1-*m* and DL2-1 through DL2-*m*, respectively. In one embodiment, the display panel 110 may include nim pixel circuits 115 arranged at locations corresponding to crossing points of the scan-lines SL1 through SLn and data-lines DL1-1 through DL1-*m* and DL2-1 through DL2-*m*.

The scan driving unit 130 may provide scan signals to the pixel circuits 115 via the scan-lines SL1 through SLn.

The first data driving unit 150 and the second data driving unit 160 provides data signals to the pixel circuits 115 via the data-lines DL1-1 through DL1-*m* and DL2-1 through DL2-*m*. The first data driving unit 150 provides data signals to pixels in an upper region of the display panel and the second data driving unit 160 provides data signals to pixels in a lower region of the display panel. A shortage of (or small) charging time may be prevented by dividing the pixels into the upper and lower regions, and an image is display by the pixels in the upper and lower regions.

In one example embodiment, the first data driving unit 150 provides data signals to the pixels in the upper region from top to bottom. The second data driving unit 160 provides data signals to the pixels in the lower region from top to bottom.

In another example embodiment, the first data driving unit 150 provides data signals to the pixels in the upper region from bottom to top. The second data driving unit 160 provides data signals to the pixels in the lower region from bottom to top.

In another example embodiment, the first data driving unit 150 provides data signals to the pixels in the upper region from bottom to top. The second data driving unit 160 provides data signals to the pixels in the lower region from top to bottom.

In another example embodiment, the first data driving unit 150 provides data signals to the pixels in the upper region from top to bottom. The second data driving unit 160 provides data signals to the pixels in the lower region from bottom to top.

The timing control unit 170 controls at least one of the scan driving unit 130, the first data driving unit 150, and the second data driving unit 160 based on a number of control signals, e.g., CTL1, CTL2, CTL3. In one embodiment, the timing control unit 170 controls the first frame memory 192, second frame memory 194, and third frame memory 196 to read and/or write the frame data.

The first frame memory 192, the second frame memory 194, and the third frame memory 196 may store the frame data (e.g., image data of frame period) to display images. The first to Mth frame data may be successively written in one of the first frame memory 192, the second frame memory 194, or the third frame memory 196 during first to Mth frame periods. Here, M is an integer which, for example, is greater than or equal to 3.

The data signals may be generated by reading (L−M)th and (L−M+1)th frame data, among the first to Mth frame data, from the one of the first frame memory, the second frame memory, or the third frame memory during an Lth frame period. Here, L is an integer ranging, for example, from (M+1) to (2M−1). The one of the first frame memory, the second frame memory, or the third frame memory may be in standby mode during (2M)th to (3M−3)th frame periods. Thus, the one of the frame memories may be in standby mode during M−2 frame periods, after all the first to Mth frame data are read.

In one embodiment, M corresponds to the number of frame data that are successively stored in the one of the frame memories. For example, M may be a maximum number of frame data simultaneously stored in the one of the first frame memory 192, the second frame memory 194, or the third frame memory 196.

Figure 7:
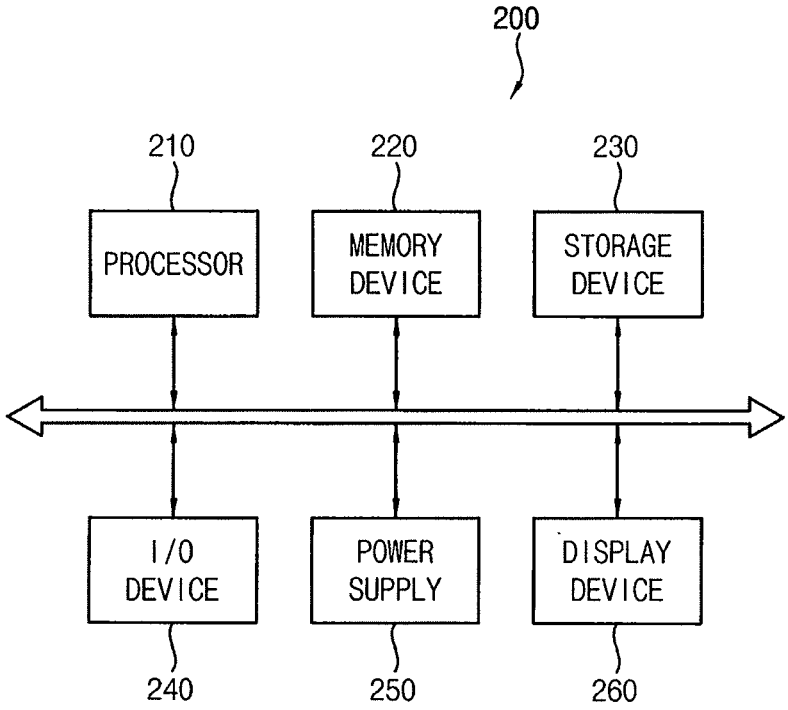
FIG. 7 illustrates an embodiment of an electronic device.

FIG. 7 illustrates an embodiment of an electronic device 200 having a display device. Referring to FIG. 7, electronic device 200 includes a processor 210, a memory device 220, a storage device 230, an input/output (I/O) device 240, a power supply 250, and a display device 260. The electronic device 200 may further include a plurality of ports for communicating with a video card, a sound card, a memory card, a universal serial bus (USB) device, and/or one or more other electronic devices.

The processor 210 may be a microprocessor, a central processing unit (CPU), or other processing device for performing various computing functions. The processor 210 may be coupled to other components, for example, via one or more of an address bus, a control bus, a data bus, etc. In one embodiment, processor 210 is coupled to an extended bus such as a Peripheral Component Interconnection (PCI) bus.

The memory device 220 may store data for operations of the electronic device 200. For example, the memory device 220 may include at least one non-volatile memory device. The memory device may be, for example, an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, or a ferroelectric random access memory (FRAM) device. Alternatively, or additionally, the memory device 220 may include at least one volatile memory device. Examples include a dynamic random access memory (DRAM) device, a static random access memory (SRAM) device, a mobile DRAM device, etc.

The storage device 230 may be, for example, a solid state drive (SSD) device, a hard disk drive (HDD) device, or a CD-ROM device. The I/O device 240 may be an input device such as a keyboard, a keypad, a touchpad, a touchscreen, a mouse, etc., and/or an output device such as a printer, a speaker, etc.

The power supply 250 may provide power for operations of the electronic device 200. The display device 260 may communicate with other components via the buses or other communication links. In one embodiment, the display device 260 corresponds to the display device 100 of FIG. 6. In this case, the display device 260 may operate using only three frame memories, and may display an image based on two successive frame data in one frame period. The one of the frame memories may be in standby mode on a regular period to thereby reduce power consumption.

The electronic device may be a television, computer monitor, laptop, digital camera, cellular phone, smart phone, smart pad, personal digital assistant (PDA), portable multimedia player (PMP), MP3 player, navigation system, game console, video phone, or another type of electronic device.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A method of driving a display device, the display device including first through third frame memories, the method comprising:

writing first to Mth frame data in the first frame memory among the first through third frame memories during first to Mth frame periods; and reading (L-M)th and (L-M+1)th frame data among the first to Mth frame data from the first frame memory to display an image corresponding to the (L-M)th and (L-M+1)th frame data during an Lth frame period, wherein M is an integer greater than or equal to 3, wherein L is an integer ranging from (M+1) to (2M-1), and wherein one of the first through third frame memories is in a standby mode at least once every two frame periods, with no two of the first through third frame memories being simultaneously in the standby mode.

2. The method as claimed in claim 1, wherein the first frame memory is in the standby mode during (2M)th to (3M-3)th frame periods.

3. The method as claimed in claim 1, wherein M is a maximum number of frame data that are simultaneously stored in the first frame memory.

4. The method as claimed in claim 1, further comprising:

writing Mth to (2M-1)th frame data in the second frame memory during Mth to (2M-1)th frame periods; and reading (L-1)th and Lth frame data among the Mth to (2M-1)th frame data from the second frame memory during an (L+M-1)th frame period, wherein the frame data read from the second frame memory corresponds to the image to be displayed.

5. The method as claimed in claim 4, wherein the second frame memory is in the standby mode during (3M-1)th to (4M-4)th frame periods.

6. The method as claimed in claim 1, further comprising:

writing (2M-1)th to (3M-2)th frame data in the third frame memory during (2M- 1)th to (3M-2)th frame periods; and reading (L+M-2)th and (L+M-1)th frame data among (2M-1)th to (3M-2)th frame data from the third frame memory during an (L+2M-2)th frame period, wherein the frame data read from the third frame memory corresponds the image to be displayed.

7. The method as claimed in claim 6, wherein the third frame memory is in the standby mode during (4M-2)th to (5M-5)th frame periods.

8. The method as claimed in claim 1, further comprising:

generating the image by driving pixels in upper and lower regions of the display device based on the read frame data.

9. The method as claimed in claim 8, wherein:

the pixels in the upper region are sequentially driven from top to bottom, and the pixels in the lower region are sequentially driven from top to bottom.

10. The method as claimed in claim 8, wherein:

the pixels in the upper region are sequentially driven from bottom to top, and the pixels in the lower region are sequentially driven from bottom to top.

11. The method as claimed in claim 8, wherein:

the pixels in the upper region are sequentially driven from bottom to top, and the pixels in the lower region are sequentially driven from top to bottom.

12. The method as claimed in claim 8, wherein:

the pixels in the upper region are sequentially driven from top to bottom, and the pixels in the lower region are sequentially driven from bottom to top.

13. A display device, comprising:

a display panel having a plurality of pixels;

a scan driver to provide a scan signals to the pixels;

a data driver to provide data signals to the pixels;

a timing controller to control the scan driver and the data driver; and first through third frame memories coupled to the timing controller, wherein the timing controller is to:

write first to Mth frame data in one of the first through third frame memories during first to Mth frame periods; and read (L-M)th and (L-M+1)th frame data among the first to Mth frame data from the one of the first through third frame memories to display an image corresponding to the (L-M)th and (L-M+1)th frame data during an Lth frame period, wherein M is an integer greater than or equal to 3, wherein L is an integer ranging from (M+1) to (2M-1), wherein one of the first through third frame memories is in a standby mode at least once every two frame periods, with no two of the first through third frame memories being simultaneously in the standby mode.

14. The display device as claimed in claim 13, wherein the one of the first through third frame memories is in the standby mode during (2M)th to (3M-3)th frame periods.

15. The display device as claimed in claim 13, wherein M is a maximum number of frame data that are to be simultaneously stored in the one of the first through third frame memories.

16. The display device as claimed in claim 13, wherein the data driver includes:

a first data driver to provide data signals to pixels in an upper region of the display panel; and a second data driver to provide data signals to pixels in a lower region of the display panel.

17. The display device as claimed in claim 16, wherein:

the first data driver provides data signals to the pixels in the upper region from top to bottom, and the second data driver provides data signals to the pixels in the lower region from top to bottom.

18. The display device as claimed in claim 16, wherein:

the first data driver provides data signals to the pixels in the upper region from bottom to top, and the second data driver provides data signals to the pixels in the lower region from bottom to top.

19. The display device as claimed in claim 16, wherein:

the first data driver provides data signals to the pixels in the upper region from bottom to top, and the second data driver provides data signals to the pixels in the lower region from top to bottom.

20. A method of driving a display device, the display device including first through third frame memories, the method comprising:

receiving frame data corresponding to a current frame period;

writing the frame data corresponding to the current frame period in at least one of the first through third frame memories;

reading two previous frame data corresponding to two successive previous periods from one of the first through third frame memories in each frame period; and displaying an image based on the two previous frame data, wherein one of the first through third frame memories is in a standby mode at least once every two frame periods, with no two of the first through third frame memories being simultaneously in the standby mode.

* * * * *